US009644488B2

(12) United States Patent
Boeck

(10) Patent No.: US 9,644,488 B2
(45) Date of Patent: May 9, 2017

(54) TURBINE STAGE WITH A BLOW-OUT ARRANGEMENT AND METHOD FOR BLOWING OUT A SEALING GAS FLOW

(71) Applicant: MTU Aero Engines AG, Munich (DE)

(72) Inventor: Alexander Boeck, Kottgeisering (DE)

(73) Assignee: MTU Aero Engines AG, Munich (DE)

( * ) Notice: Subject to any disclaimer, the term of this patent is extended or adjusted under 35 U.S.C. 154(b) by 372 days.

(21) Appl. No.: 14/286,573

(22) Filed: May 23, 2014

(65) Prior Publication Data

US 2014/0348633 A1 Nov. 27, 2014

(30) Foreign Application Priority Data

May 27, 2013 (DE) ..... 10 2013 209 746

(51) Int. Cl.
*F01D 11/00* (2006.01)
*F01D 11/10* (2006.01)
*F01D 5/30* (2006.01)

(52) U.S. Cl.
CPC ..... *F01D 11/10* (2013.01); *F01D 11/001* (2013.01); *F01D 5/3015* (2013.01)

(58) Field of Classification Search
CPC ..... F01D 11/001; F01D 11/02; F01D 11/04; F01D 11/06; F01D 11/10; F01D 9/023; F01D 9/065
See application file for complete search history.

(56) References Cited

U.S. PATENT DOCUMENTS 5,217,348 A * 6/1993 Rup, Jr. ..... F01D 25/12 415/115
5,352,087 A * 10/1994 Antonellis ..... F01D 11/025 415/115
6,065,928 A * 5/2000 Rieck, Jr. ..... F01D 5/189 415/115
7,121,791 B2 * 10/2006 Friedl ..... F01D 11/00 415/115
2010/0183426 A1 7/2010 Liang
2011/0193293 A1 8/2011 Mega et al.

FOREIGN PATENT DOCUMENTS

DE 693 05 326 T2 5/1997
DE 693 27 180 T2 6/2000
DE 699 26 574 T2 5/2006

OTHER PUBLICATIONS

European Search Report dated Sep. 29, 2014 (Seven (7) pages).
German Office Action dated Apr. 10, 2014 (Six (6) pages).

* cited by examiner

*Primary Examiner* — John K Fristoe, Jr.
*Assistant Examiner* — Sabbir Hasan
(74) *Attorney, Agent, or Firm* — Crowell & Moring LLP

(57) ABSTRACT

A turbine stage having a gas channel in which at least one rotor assembly is disposed, is disclosed. A cavity communicates with the gas channel and is delimited by a front side of a rotor element and by a rotor element-mounted seal. A blow-out arrangement with at least one gas passage for blowing out a sealing gas flow into the cavity is provided, where the gas passage for blowing out the sealing gas flow is configured with a swirl in the circumferential direction and has an outlet opening that is offset radially outwardly from the rotor element-mounted seal.

13 Claims, 1 Drawing Sheet

TURBINE STAGE WITH A BLOW-OUT ARRANGEMENT AND METHOD FOR BLOWING OUT A SEALING GAS FLOW

This application claims the priority of German Patent Application No. DE 102013209746.8, filed May 27, 2013, the disclosure of which is expressly incorporated by reference herein.

BACKGROUND AND SUMMARY OF THE INVENTION

The present invention relates to a turbine stage of a gas turbine having a blow-out arrangement for blowing out a sealing gas flow into a cavity, a method for operating such a turbine stage and a gas turbine with such a turbine stage.

A turbine stage comprises a gas channel, in which most of the time a plurality of guide vane and rotor assemblies are disposed in order to transform the energy of a working gas flowing through the gas channel into torque of a rotor of the gas turbine.

Communicating with the gas channel are cavities, for example radial recesses in the rotor, in which radially inner blade tips or inner shrouds of guide vane assemblies engage. In order to reduce a leakage flow through these types of cavities, they may be delimited by one or more seals. In particular, a seal can differentiate an upstream cavity with respect to a downstream cavity in order to prevent an undesired underflowing of a guide vane assembly.

To reduce or prevent an entry of hot working gas into such cavities, blowing a sealing gas flow into the cavity is known from internal company practice. If the cavity is subject to radial blow-in, shear flows can occur at a rotor-mounted front side due to the circumferential velocity of the rotor.

One object of an embodiment of the present invention is to improve an operation of a gas turbine.

A turbine stage according to one aspect of the present invention comprises a gas channel in which one or a plurality of rotor assemblies are disposed, and through which a working gas flows during operation, in particular an exhaust gas from an upstream combustion chamber. A guide vane assembly can be disposed before and/or after at least one rotor assembly. The rotor channel can diverge in the direction of flow, at least in sections.

Communicating with the gas channel is at least one cavity, which is delimited by a front side of a single- or multi-part rotor element and by a rotor element-mounted seal.

The rotor element can comprise a rotor blade arrangement having one or a plurality of rotor blades of a rotor assembly of the turbine stage, which can be connected detachably or permanently, in particular integrally, to a rotor of the turbine stage.

In one embodiment, the front side axially delimits the cavity or forms a, in particular downstream, front wall of the cavity. In one embodiment, the seal delimits the cavity likewise axially or forms a, in particular upstream, front wall of the cavity.

In one embodiment, the cavity can be delimited radially outwardly by a further rotor element-mounted seal, through which the cavity communicates with the gas channel, in particular a labyrinth seal having one or a plurality of axial flanges, which can be opposite from one or a plurality of housing-mounted axial flanges of the turbine stage.

In one embodiment, the cavity can be delimited radially inwardly by an axial projection of the rotor element front side, in particular a seal carrier, on which the rotor element-mounted seal is disposed.

The cavity can be, in particular, a chamber between a rotor blade disk and an inner shroud of a, in particular upstream, guide vane assembly. In one embodiment, the turbine stage comprises a guide vane assembly with a radially inner counter seal, in particular an abradable lining, which is opposite from the rotor element-mounted seal and with the seal defines a sealing gap, which preferably, at least substantially, can be parallel to an axis of rotation of the turbine stage. The rotor element-mounted seal can be, in particular, a labyrinth seal having one or a plurality of radial sealing flanges, in particular radial sealing tips, which are radially opposite from the counter seal, in particular a honeycomb seal. In particular, the rotor element-mounted seal can delimit the cavity against a further, upstream cavity.

The turbine stage comprises a blow-out arrangement having one or a plurality of gas passages distributed over the circumference, preferably equidistantly, for blowing out a sealing gas flow, in particular a sealing air flow, into the cavity.

According to one aspect of the present invention, one or a plurality of, preferably all gas passages of the blow-out arrangement for blowing out the sealing gas flow, can be configured with a swirl in the circumferential direction, which in one embodiment is in the same direction as a rotational direction of the turbine stage. In this way, in one embodiment, a circumferentially swirling sealing flow can be blown-in in front of the rotor element-mounted front side so that shear flows based on the circumferential velocity of the rotor are reduced or prevented and thus, in particular, the efficiency and therefore the operation of the turbine stage can be improved.

A leakage flow can enter the cavity via the rotor element-mounted seal. This may be desired, in particular, in order to cool the rotor element, in particular the front side thereof, through the leakage flow. However, if the preferably non-swirling leakage flow directly hits the swirling sealing gas flow, the intermixture thereof can reduce the circumferential swirl of the sealing gas flow.

Therefore, according to one aspect of the present invention, an outlet opening of one or a plurality of, preferably all gas passages of the blow-out arrangement, is offset radially outwardly from the rotor element-mounted seal. The sealing gas flow is so to speak guided radially away by the blow-out arrangement through a leakage flow via the rotor element-mounted seal and first blown out radially outwardly with a swirl so that a malfunction from the leakage flow is reduced, in particular at least substantially prevented.

According to one aspect of the present invention, the sealing gas flow is accordingly blown out radially outwardly from the rotor element-mounted seal into the cavity by the blow-out arrangement with a swirl in the circumferential direction.

A gas passage can be curved in the circumferential direction for blowing out the sealing gas flow with a swirl in the circumferential direction. In addition or as an alternative, one or a plurality of deflection elements or surfaces can be disposed in a gas passage in order to apply a velocity component in the circumferential direction to the sealing gas flow flowing through the passage.

In one embodiment, a gas passage is configured as a through-borehole or continuous opening or passage of a pipe. The pipe can be produced as a separate component and be detachably or permanently fastened on the rotor element, in particular a rotor element-mounted seal carrier on which the rotor element-mounted seal is disposed, and in particular can be connected by bonding, frictionally or with a form-fit, in particular welded, adhered, soldered, locked in place, screwed together or inserted. Similarly, a pipe can also be configured integrally with the rotor element, in particular by a pipe jacket being laid open by machining around a through-borehole, in particular free milled.

In one embodiment, the pipe can extend, at least substantially, over its length, or in at least one section, preferably at least in a quarter of the length thereof next to the outlet opening, at least substantially in a plane, which is perpendicular to an axis of rotation of the turbine stage. Through this, the sealing gas flow in one embodiment can be guided in a short path through the leakage flow. In a further development, the pipe can be inclined, at least in sections, preferably at least in a quarter of the length thereof next to the inlet opening, relative to the axis of rotation of the turbine stage, in particular, in order to axially offset an inlet opening.

In one embodiment, one or a plurality of preferably all gas passages of the blow-out arrangement comprise an inlet opening, which communicates with a pressure reservoir, in particular a sealing air reservoir. In a further development, a bypass passage between the pressure reservoir and the cavity is connected in parallel in terms of flow to the blow-out arrangement. The bypass passage can be defined, in particular, by the rotor element-mounted seal, preferably a sealing gap between the seal and an opposite counter seal, in particular an abradable lining, preferably of a guide vane assembly. Therefore, in one embodiment, a pressurized gas, in particular air, preferably from a compressor upstream from the turbine stage, is guided into an upstream, further cavity and divided there into a, preferably greater, leakage flow via the rotor element-mounted seal, in particular for cooling the rotor element, and a, preferably smaller, sealing gas flow. Correspondingly, in one embodiment, the turbine stage can comprise an upstream, further cavity, which communicates with a pressure reservoir, a sealing gap via the rotor element-mounted seal and the blow-out arrangement.

A turbine stage according to the invention can be used in particular in a gas turbine, preferably an aircraft engine.

Other advantageous further developments of the present invention are disclosed in the following description of preferred embodiments.

DETAILED DESCRIPTION OF THE DRAWINGS

Figure 1:
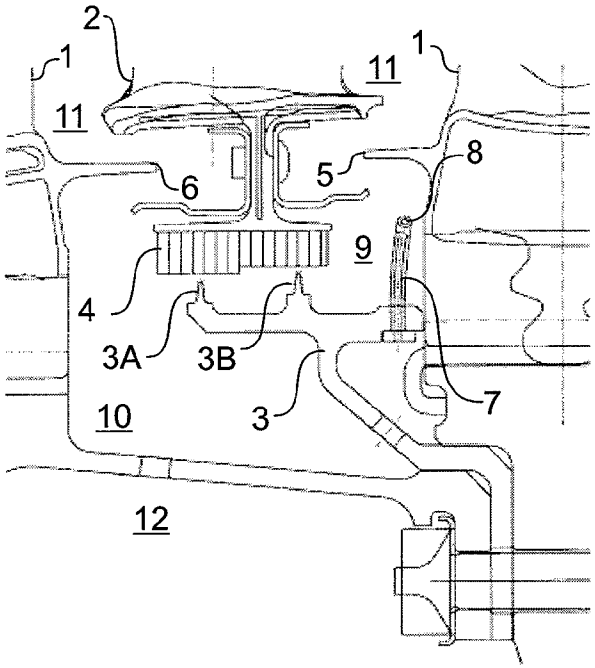
FIG. 1 is a meridian section of a portion of a turbine stage according to an embodiment of the present invention.

FIG. 1 shows a meridian section of a portion of a turbine stage according to an embodiment of the present invention with a gas channel 11, in which a plurality of rotor assemblies are disposed, two rotor blades, one of which is partially visible in FIG. 1. Disposed between the blades is a guide vane assembly, one guide vane 2 of which is partially visible in FIG. 1.

Communicating with the gas channel is a downstream cavity 9, which is delimited axially by a front side of a rotor element in the form of a rotor blade disk, with the right-hand rotor blades 1 in FIG. 1 and by a rotor element-mounted labyrinth seal with radial flanges in the form of radial sealing tips 3A, 3B.

The front side forms a downstream front wall of the cavity 9 (on the right in FIG. 1). The seal 3A, 3B delimits the cavity 9 likewise axially (towards the left in FIG. 1).

The cavity 9 is delimited radially outwardly by a further rotor element-mounted labyrinth seal 5, through which the cavity communicates with the gas channel 11.

Radial inwardly, the cavity 9 is delimited by a seal carrier 3 on which the rotor element-mounted seal 3A, 3B is disposed.

Thus, the cavity forms a chamber between the rotor blade disk and an inner shroud of the upstream guide vane assembly with the guide vanes 2. The guide vane assembly comprises a radially inner counter seal in the form of an abradable lining 4, which is opposite from the rotor element-mounted seal 3A, 3B and defines, with the seal, a sealing gap, which is parallel to an axis of rotation of the turbine stage (horizontal in FIG. 1). The rotor element-mounted seal is a labyrinth seal having two radial sealing tips 3A, 3B, which are radially opposite from the abradable lining in the form of a honeycomb seal 4. The rotor element-mounted seal 3A, 3B delimits the cavity 9 against a further, upstream cavity 10, which incidentally is delimited by a labyrinth seal 6 and a downstream front side of the left rotor assembly in FIG. 1, the seal carrier 3 and the connecting flange thereof to the left rotor assembly in FIG. 1 and communicates with a pressure reservoir 12 and via the labyrinth seal 6 likewise with the gas channel 11.

The turbine stage comprises a blow-out arrangement with a plurality of gas passages distributed equidistantly over the circumference for blowing out a sealing air flow into the cavity 9.

The gas passages are configured as through-borehole of pipes, one pipe 7 of which is depicted in FIG. 1. The pipe 7 in the embodiment in FIG. 1 is produced as a separate component and is detachably or permanently fastened on the rotor element-mounted seal carrier 3 on which the rotor element-mounted seal 3A, 3B is disposed, in particular connected by bonding, frictionally or with a form-fit, in particular welded, adhered, soldered, locked in place, screwed together or inserted. In a modification (not shown), the pipe can also be configured integrally with the seal carrier, by a pipe jacket being laid open by machining around a through-borehole, in particular free milled.

The pipes 7 and therefore also the through-boreholes or gas passages thereof are curved in the circumferential direction (from the plane of projection of FIG. 1) in order to blow out a sealing gas flow with a swirl in the circumferential direction, which is in the same direction as a rotational direction of the turbine stage. In this way, a circumferentially swirling sealing flow can be blown-in in front of the rotor element-mounted front side so that a shear flow based on the circumferential velocity of the rotor is reduced or prevented, and thus, in particular, the efficiency and therefore the operation of the turbine stage are improved.

A leakage flow enters the cavity 9 via the rotor element-mounted seal 3A, 3B. This is desired in order to cool the front side of the rotor blade disk and/or the disk-blade connection though the leakage flow.

Outlet openings 8 of the pipes 7 or the gas passages thereof are offset radially outwardly from the rotor element-mounted seal 3A, 3B (vertically upwards in FIG. 1). The sealing gas flow is so to speak guided radially away by the blow-out arrangement through a leakage flow via the rotor element-mounted seal and first blown out radially outwardly with a swirl so that a malfunction from the leakage flow is reduced, preferably prevented.

In the embodiment in FIG. 1, the pipes 7 extend over their entire length in a plane, which is perpendicular to an axis of rotation of the turbine stage (vertical plane on the plane of projection of FIG. 1). Through this, the sealing gas flow in one embodiment can be guided in a short path through the leakage flow.

Figure 2:
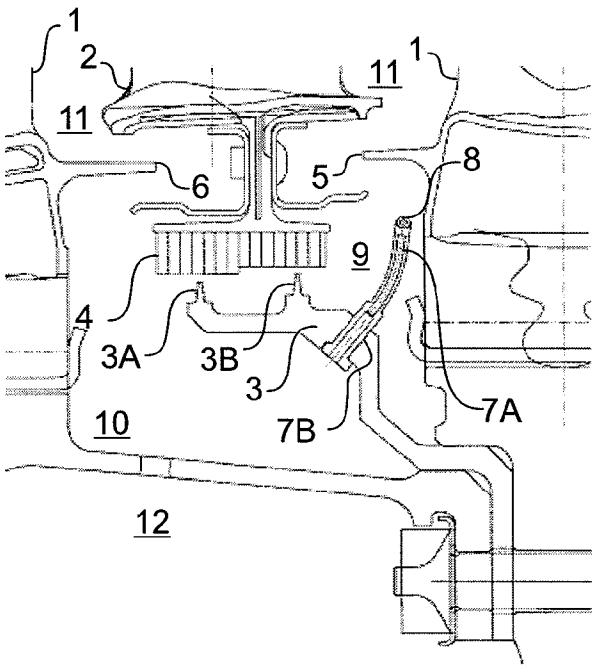
FIG. 2 is a portion of a turbine stage according to another embodiment of the present invention in a representation corresponding to FIG. 1.

In the embodiment in FIG. 2, which incidentally conforms to that of FIG. 1, so that elements corresponding with one another are designated with conforming reference numbers and reference is made to the description of the embodiment in FIG. 1, the pipes 7 extend in a half 7A of the length thereof next to the outlet opening (top in FIG. 2), likewise in the plane perpendicular to the axis of rotation. In a half 7B of the length thereof next to the inlet opening (bottom in FIG. 2), they are, however, inclined by approx. 45° relative to the axis of rotation of the turbine stage, in particular, in order to offset the inlet openings thereof axially upstream.

A bypass passage is defined by a sealing gap between the rotor element-mounted seal 3A, 3B and the opposite abradable lining 4 of the guide vane assembly and connected in parallel in terms of flow to the blow-out arrangement.

Both this sealing gap via the rotor element-mounted seal 3A, 3B and the pipes 7 of the blow-out arrangement communicate with the upstream, further cavity 10 and via the cavity with the pressure reservoir 12. Therefore, a pressurized gas, in particular air, preferably from a compressor upstream from the turbine stage, is guided into the upstream, further cavity 10 and divided there into a, preferably greater, leakage gas flow via the rotor element-mounted seal 3A, 3B for cooling the rotor element and a, preferably smaller, sealing gas flow via the blow-out arrangement. The gas passages of the blow-out arrangement each comprise an inlet opening, which communicates with the pressure reservoir 12 via the upstream, further cavity 10.

Although exemplary embodiments were explained in the foregoing description, it should be noted that a plurality of modifications is possible. It should also be noted that the exemplary embodiments are merely examples, which should not restrict the protective scope, the applications and construction in any manner. On the contrary, the foregoing description provides a person skilled in the art with a guideline for implementing at least one exemplary embodiment, wherein various modifications, in particular with respect to the function and arrangement of the described components, can be undertaken without leaving the protective scope, as yielded by the claims and these equivalent combinations of features.

LIST OF REFERENCE CHARACTERS

1 Rotor blade (arrangement/assembly)
2 Guide vane (arrangement/assembly)
3 Seal carrier
3A, 3B Radial sealing tip (radial sealing flange, rotor element-mounted seal)
4 Abradable lining with honeycomb seal (counter seal)
5 Axial flange (labyrinth seal (further rotor element-mounted seal))
6 Axial flange (labyrinth seal)
7 Pipe (blow-out arrangement)
7A Pipe half next to the outlet opening
7B Pipe half next to the inlet opening
8 Outlet opening
9 Cavity
10 Upstream, further cavity
11 Gas channel
12 Pressure reservoir As also discussed above, the foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A turbine stage, comprising:
a gas channel;
a rotor assembly disposed in the gas channel;
a cavity, wherein the cavity is in communication with the gas channel and wherein the cavity is defined by a front side of a rotor element and by a rotor element-mounted seal; and
a blow-out arrangement with a gas passage, wherein a sealing gas flow is blowable out of the gas passage into the cavity;
wherein the gas passage is configured with a swirl in a circumferential direction and includes an outlet opening which is offset radially outwardly from the rotor element-mounted seal;
and wherein the gas passage is a through-borehole of a pipe and wherein the pipe is fastened to the rotor element or integrally configured with the rotor element.

2. The turbine stage according to claim 1, wherein the gas passage is curved in the circumferential direction.

3. The turbine stage according to claim 1, wherein the pipe extends, at least in sections, next to the outlet opening in a plane which is perpendicular to an axis of rotation of the turbine stage.

4. The turbine stage according to claim 1, further comprising a rotor element-mounted seal carrier on which the seal and the pipe are disposed.

5. The turbine stage according to claim 1, wherein the gas passage includes an inlet opening which is in communication with a pressure reservoir.

6. The turbine stage according to claim 5, further comprising a bypass passage between the pressure reservoir and the cavity that is parallel in terms of flow to the blow-out arrangement.

7. The turbine stage according to claim 1, wherein the cavity is defined radially outwardly by a second rotor element-mounted seal.

8. The turbine stage according to claim 1, wherein the rotor element-mounted seal is a labyrinth seal with at least one radial sealing flange.

9. The turbine stage according to claim 1, wherein the rotor element comprises a rotor blade arrangement with at least one rotor blade.

10. The turbine stage according to claim 1, further comprising a guide vane assembly with a radially inner counter seal which is disposed opposite from the rotor element-mounted seal and which defines a sealing gap with the rotor element-mounted seal.

11. A gas turbine comprising at least one turbine stage according to claim 1.

12. The gas turbine according to claim 11 wherein the gas turbine is an aircraft engine.

13. A method for operating a turbine stage according to claim 1, comprising the step of:
blowing out the sealing gas flow radially outwardly from the rotor element-mounted seal into the cavity by the blow-out arrangement with a swirl in the circumferential direction.

* * * * *